United States Patent [19]

Newell

[11] 4,382,743

[45] May 10, 1983

[54] LOADING APPARATUS WITH A TILTABLE AND EXTENDABLE FORK CARRIAGE MOUNTED THEREON

[76] Inventor: Lawrence H. Newell, 644 S. 215th St., Elkhorn, Nebr. 68022

[21] Appl. No.: 236,990

[22] Filed: Feb. 23, 1981

[51] Int. Cl.[3] ..... E02F 3/72

[52] U.S. Cl. ..... 414/692; 414/718; 414/728; 212/231

[58] Field of Search ..... 414/687, 690, 692, 718, 414/728, 743, 697, 608, 668, 589; 212/184, 230, 231

[56] References Cited

U.S. PATENT DOCUMENTS 3,747,789 7/1973 Shipley et al. ..... 414/718 X
3,910,440 10/1975 Holtcamp et al. ..... 414/718 X
4,082,197 4/1978 Stedman ..... 414/718 X
4,306,832 12/1981 Schmiesing ..... 414/692 X

FOREIGN PATENT DOCUMENTS 1904939 11/1969 Fed. Rep. of Germany ..... 414/718
190522 7/1964 Sweden ..... 414/718

*Primary Examiner*—Robert J. Spar
*Assistant Examiner*—Terrance L. Siemens
*Attorney, Agent, or Firm*—Peterson, Palmatier, Sturm, Sjoquist & Baker, Ltd.

[57] ABSTRACT

The apparatus includes a mobile chassis having a turntable on which is supported a boom assembly. At the free end of the boom assembly is tiltably mounted a forklift carriage which can be extended and retracted relative to the boom assembly.

21 Claims, 5 Drawing Figures

Fig. 5
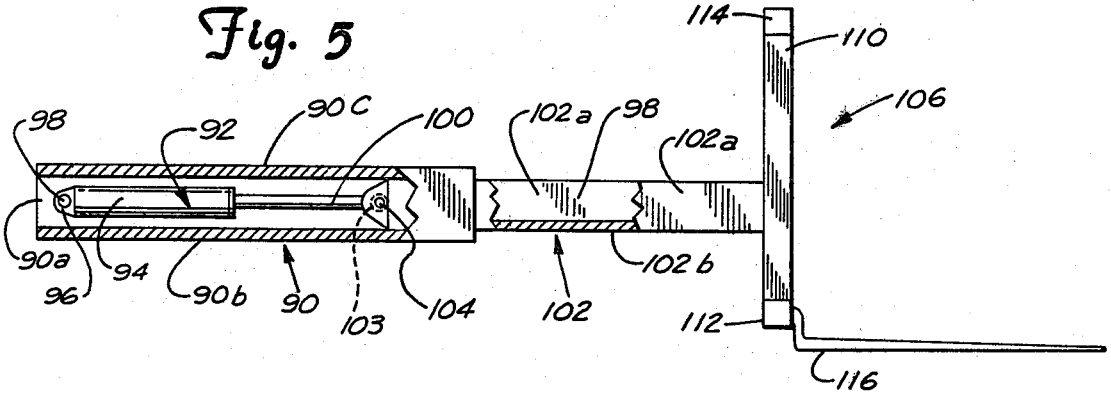
Fig. 4
Fig. 1
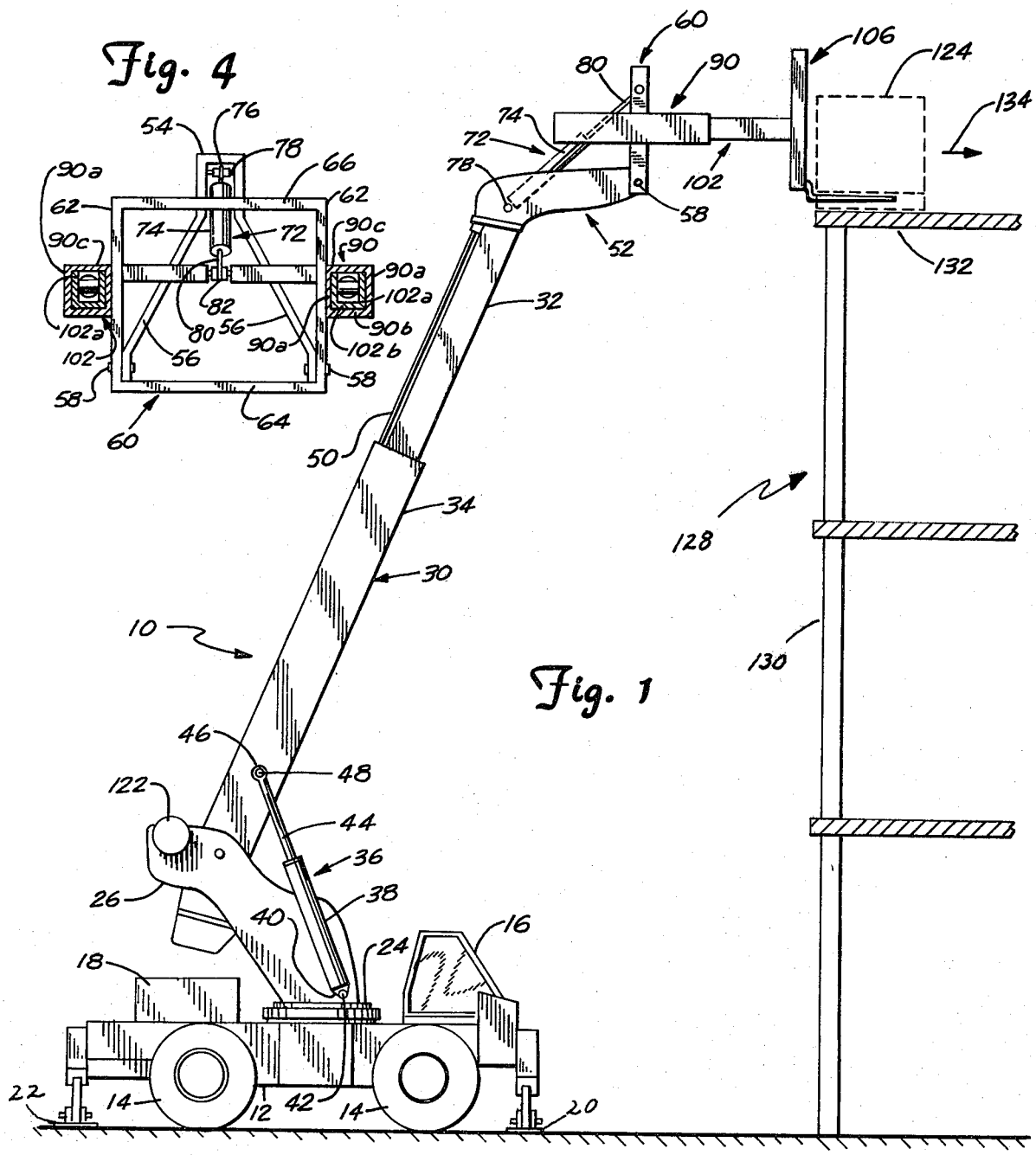

10
12
14
16
20
22
24
28
34
36
38
46
48
50
52
54
56
60
72
90
98
102
106
114
116
122

4
4
10
12
14
16
18
20
22
24
26
28
30
32
34
36
38
40
42
44
46
48
50
52
56
60
72
74
78
90
102
106
110
112
114
116
122

LOADING APPARATUS WITH A TILTABLE AND EXTENDABLE FORK CARRIAGE MOUNTED THEREON

BACKGROUND OF THE INVENTION

1. Field of the Invention

This invention relates generally to so-called high lift loaders, and pertains more particularly to loading apparatus of this general character in which the fork carriage mounted at the free end of the telescopic boom assembly can be tilted about a horizontal axis and also extended and retracted in a rectilinear direction.

2. Description of the Prior Art

It has been common practice to tiltably mount a fork carriage at the free end of the telescopic boom assembly. In order to impart horizontal movement to the fork carriage at whatever elevation it has been moved into, such an arrangement involves the movement of the vehicle or tractor in order to position the forks of the carriage relative to an elevated location where a load is to be deposited or removed, as the case may be.

Since the vehicle is mobile, it being contemplated that it be moved from one vantage point to another, the cost of manufacturing a vehicle with a telescopic boom assembly and a tiltable fork carriage thereon is not increased. However, it is difficult to move the vehicle in increments accurate enough in every situation. This becomes particularly troublesome where the load is out of sight as far as the operator is concerned.

The foregoing problem has been recognized and has been generally corrected by providing longitudinally directed tracks or rails on the chassis along which a transfer carriage is reciprocated. While the arrangement just alluded to has worked well in actual practice, nonetheless the initial cost of the equipment has been substantially increased. Also, greater power requirements are necessary inasmuch as a relatively large mass must be shifted back and forth. Nonetheless, this is a decided improvement over the earlier prior art in which the vehicle itself must be moved back and forth.

A problem common to both prior art situations is that frequently the load must be placed on an upper floor or roof of a building under construction. A vertical wall can offer interference and whether the entire vehicle is moved or whether a transfer carriage is employed can interfere with the placement of the load, for there will be interference between the boom assembly and the wall, thereby necessitating that the load be placed near the wall whereas it is frequently desirable to place the load as far inwardly from the wall as possible.

At any rate, an example of the prior art referred to above in which a transfer carriage is moved along longitudinally disposes tracks on the vehicle is described in U.S. Pat. No. 4,147,263, issued Apr. 3, 1979, to Sherman B. Frederick et al for "High Lift Loader With Extended Transfer".

SUMMARY OF THE INVENTION

Accordingly, a general object of the present invention is to obviate the need for moving a vehicle having a telescopic boom assembly and fork lift carriage thereon relative to an elevated location where a load is to be deposited or removed. Also, an aim of the invention is to avoid the use of a transfer carriage that is movable along longitudinally disposed tracks associated with the vehicle, thereby reducing the initial cost of the loading apparatus.

Another object of the present invention is to provide loading apparatus having increased versatility inasmuch as the operator has a choice of moving the vehicle itself when circumstances so dictate, or where an incremental movement in a horizontal direction is satisfactory, then resorting to the extension (or retraction) in a generally horizontal direction, moving only the fork carriage mounted at the upper end of the telescopic boom assembly.

Another object is to provide for the tilting of the fork carriage about a horizontal axis, and actually extending or retracting the fork carriage independently of whatever angle of tilt has been realized.

A further object is to minimize the amount of mass that need be shifted in order to accurately position a load for unloading or for pick up, as the case may be. More specifically, it is contemplated that only the fork carriage be extended or retracted in order to move the load, obviating any need for moving the entire vehicle or a massive transfer carriage mounted for movement thereon, all as being practiced with prior art handling apparatus.

Yet another object of the invention is to achieve multiple movements of a fork carriage with equipment that costs very little more than equipment not possessing the movement capabilities envisaged with my invention.

Also, the invention has for an object the use of automatic leveling mechanisms which will maintain the fork carriage level irrespective of any degree of angulation or extension of the telescopic boom assembly, or to permit the operator to "override" the automatic controls so that he can obtain whatever tilt is best suited for the conditions he is currently experiencing in the handling of a given load. In other words, the fork carriage can be slaved with the boom lift hydraulic cylinder or an independent slave cylinder can be employed. Additionally, though, the operator can change the tilt angle to suit the conditions at hand by judging the angle of the boom assembly, and then manually overriding the automatic controls as pointed out above.

In general, an object of the present invention is to preserve all of the various types of movements heretofore expected of material handling equipment making use of a telescopic boom assembly, yet permitting the operator to exercise precise control in the positioning of the fork carriage.

A still further object of the invention is to reduce the amount of counterbalancing and outrigging that is required, for it is within the purview of the invention to shift the center of gravity of the equipment only slightly by reason of the extension or retraction of the fork carriage. Stated somewhat differently, once the boom assembly has been properly extended and angled, then there is only a slight change in the center of gravity when practicing my invention because only a small amount of mass, more specifically the fork carriage itself, need be extended. Even this shift in the center of gravity can readily be accommodated by reason of an outrigger mechanism. This is in direct contrast to the alluded to patented apparatus because in that situation a considerable amount of mass must be shifted in order to move the fork carriage, namely, the entire boom assembly.

Still another object of the invention is to provide a material handling apparatus in which the fork carriage can be horizontally moved once the proper elevation of the carriage has been realized, this being achievable without movement of the boom assembly and possible attendant interference thereof with the vertical wall of a building undergoing construction.

Also, the invention has for a further object to provide 360° rotation of an extended type fork lift, a feature not heretofore commercially available.

Briefly, my invention contemplates a mobile chassis having a turntable mounted thereon. A telescopic boom assembly is pivotally carried on the turntable so that it can be rotated through 360° and also swung upwardly and downwardly about a horizontal axis. At the free end of the telescopic boom assembly is a boom head fixedly mounted thereon. The boom head serves as a first frame or support. A second frame or support is pivotally mounted or attached to the first claim or support and can be tilted relative to the boom head, as well as the boom assembly, by means of a tilt cylinder or ram. On the second support or frame are a pair of rams, each utilizing a hydraulic cylinder and a piston rod that can be extended and retracted with respect to such cylinder. The piston rods are attached to slidable arms that ride in box-like members housing the hydraulic cylinders. The free ends of the slidable arms are fixedly attached to the fork carriage which includes a third support to which the fork members are attached. Hence, irrespective of whatever angle the boom assembly is manipulated into, the fork carriage can be tilted with respect to the boom assembly and, independently of the tilted angle, the fork carriage can be extended or retracted in order to unload or pick up a load at relatively high elevations.

BRIEF DESCRIPTION OF THE DRAWINGS

FIG. 1 is a side elevational view of apparatus exemplifying my invention, the telescopic boom assembly being elevated and the fork carriage being extended with respect to the free end of the boom assembly to which it is tiltably mounted;

FIG. 4 is a sectional detail taken in the direction of line 4—4 of FIG. 2, and FIG. 5 is an enlarged side elevational view of the fork carriage, as it appears in FIG. 1, and also one of the rams for extending and retracting the fork carriage, a portion of the box being broken away to show the ram therein and a portion of the arm activated by the ram also being broken away to show its channeled shape.

DESCRIPTION OF THE PREFERRED EMBODIMENT

Figure 3:
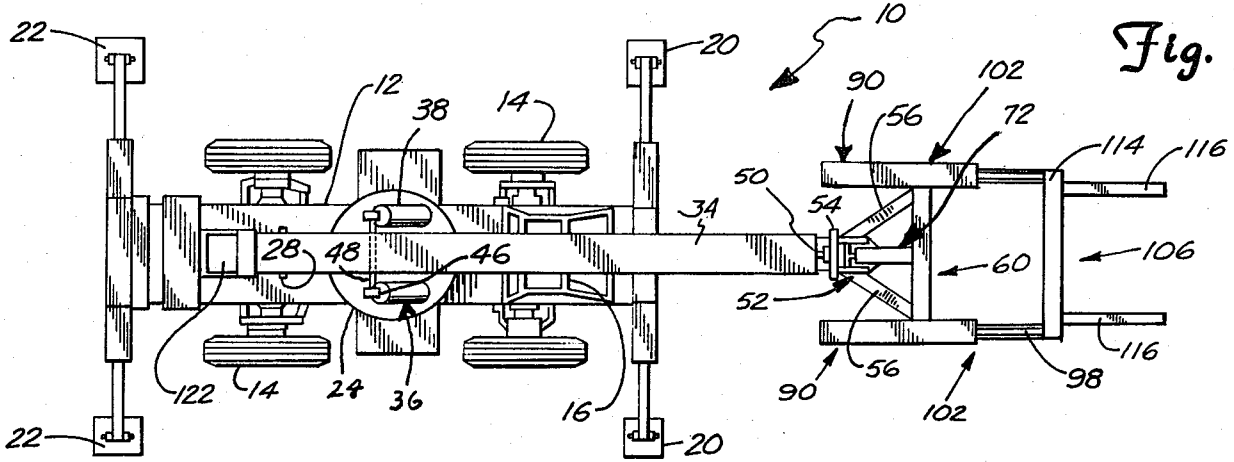
FIG. 3 is a top plan view corresponding to FIG. 2.

Loading apparatus illustrating my invention has been denoted generally by the reference numeral 10. In this regard, the apparatus 10 includes a chassis 12 that is made mobile by reason of a plurality of wheels 14. The chassis 12 has a cab 16 located toward the front and an engine 18 located rearwardly. The engine 18 provides mechanical power for the wheels 14 as well as driving several pumps which furnish hydraulic power for equipment hereinafter referred to.

It will be observed that there are outriggers 20 and 22 comprised of leveling jacks that are located at the front and rear of the chassis 12 for the purpose of stabilizing the entire apparatus 10, particularly when lifting relatively heavy loads.

Centrally located on the chassis 12 is a turntable 24. The turntable 24 is of conventional construction, involving the presence of a circular rack and a pinion, neither of which are visible. The pinion is in mesh with the circular rack and is driven by a hydraulic motor (also not shown) which receives hydraulic fluid under pressure from one of the pumps driven by the engine 18. The turntable 24 has a pair of laterally spaced upright standards 26 disposed thereon so as to be rotatable about a vertical axis when the turntable 24 is rotated by reason of the hydraulic motor. The upright standards 26 have extending therebetween a horizontal shaft 28.

The shaft 28 provides a horizontal pivotal axis for a boom assembly indicated generally by the reference numeral 30. While the boom assembly 30 can be comprised of any number of telescopic boom sections, two such sections are depicted. The section labeled 34 is pivotally mounted on the shaft 28, whereas the section 32 is telescopically received within the first section 34.

The entire boom assembly 30 is raised and lowered, that is, pivoted about the horizontal axis provided by the shaft 28, through the agency of a pair of lift rams 36, each having a cylinder 38 with an eye 40 at its closed end through which a pin or stub shaft 42 extends. A piston rod 44 is extensibly and retractably mounted within the cylinder 38, having an eye 46 at its free end which connects with a pin or a shaft 48.

When hydraulic fluid is delivered under pressure to the closed or lower ends of the cylinders 38, then the rods 44 are extended so as to swing the boom section 32 upwardly in a conventional manner. The second boom section 32 is telescopically received within the first boom section 34. A portion of the mechanism for extending (and also retracting) the boom section 32 from the boom section 34 is denoted by the reference numeral 50.

At a free or other end of the boom assembly 30, more specifically, at the end of the boom section 32, is a boom head or first support 52. The boom head or support 52 is welded or pinned securely in place at the free end of the boom section 34. The boom head or support 52 is comprised of a central web portion 54 from which arms 56 diverge downwardly and outwardly. The lower ends of the diverging arms 56 each have a pin or shaft 58 employed for a purpose explained below.

At this time attention is directed to a carriage head or second support 60. From FIG. 4 it can be appreciated that the head or support 60 has a rectangular configuration, having vertical side portions 62, a bottom or cross beam 64 and a top or cross beam 66. The pins or shafts 58 at the lower ends of the arms 56 extend through the sides 62 of the head 60 to pivotally mount the entire head or support 60 to the boom head or support 52.

A tilt ram 72 (best seen in FIG. 4) is employed which is comprised of a hydraulic cylinder 74 having an ear 76 at its closed end or more elevated end, the ear 76 being apertured so as to receive therethrough a pin 78. The hydraulic cylinder 74 contains a piston rod 80 which has an ear 82 at its free end which connects with the central portion of a cross beam 84 which is integral with the sides 62. It will be understood that the cross beam 84 constitutes a diagrammatic representation of the way the free end of the piston rod 80 is connected to the carriage head or second support 60. In any event, by means of a pin 86, which passes through the apertured ear 82, the ram 72, in the illustrated example, is connected at the one end to the boom head or support 52 and at the other end to the carriage head or support 60, as just mentioned.

Welded or otherwise secured to the sides 62 of the carriage head or support 60 is a pair of box-like or tubular housings 90 having parallel sidewalls 90*a*, a bottom wall 90*b* and top wall 90*c*. A ram 92 is contained within each housing 90 which ram in each instance includes a hydraulic cylinder 94 having an ear 96 at its closed end which is anchored between the sidewalls 90*a* of the box-like housing by means of a pin 98 (see FIG. 5). The cylinder 94 in each instance contains therein a piston rod 100 which is extensible and retractable within its particular cylinder 94. Channel-shaped slidable arms 102 have laterally spaced sidewalls 102*a* and a bottom wall 102*b*. Each arm 102 is guided for reciprocal movement within the box-like housing 90 with which it is associated, being connected to the free end of the piston rod 100 (which has an eye 103 integral therewith) by a pin 104. More specifically, the pin 104 has its ends anchored in the sidewalls 100*a* of the channel-shaped arm 100. Stated somewhat differently, the depicted arrangement can be compared with a crosshead and wrist pin, the arm 102 serving much like a crosshead and the pin 104 serving as a wrist pin therefor. It should be appreciated that the channel-shaped arm 100 in each instance slides within the box-like housing 90, being reciprocably actuated by its ram 92.

A fork carriage is indicated generally by the reference numeral 106. It includes a box frame 108 having vertical sides 110, a bridging bottom portion 112 and a bridging top portion 114. The box frame 108 supports a pair of fork members 116, the fork members 116 being attached to the bottom portion 112 and laterally spaced with respect to each other as can readily be seen from FIG. 3.

From the foregoing, it will be recognized that the fork carriage 106 is mounted so as to be extendable and retractable with respect to the boom assembly 30, more specifically by means of the arms 102 that are slidably received in box-like or tubular housings 90. The boom head 52 functions as one support and the carriage head 60 functions as a second support. It should be borne in mind, however, that the support 60 is tiltable relative to the support 52 by means of the ram 72.

Although conventional, it can be pointed out that there is usually incorporated into lift apparatus of this general type a slave cylinder that will cause the tilt cylinder, such as that labeled 72, to assume various extended positions so that the fork carriage, such as that denoted by the reference numeral 106 will remain level as the boom assembly 30 is raised and lowered. Of course, it is rather common practice for the tilt ram 72 to be manually operated so that various tilted positions of the fork carriage 106 can be realized independently of the raised or lowered condition of the boom assembly 30. Consequently, since the slaving of the fork carriage 106 with respect to the boom assembly 30 is conventional and not part of my invention no need is seen for picturing the equipment that would automatically maintain the fork carriage 106 level as the boom assembly 30 is raised and lowered. Besides, it has already been pointed out that the operator can maintain the carriage 106 level, that is the fork members 116 horizontal, by manually controlling the tilt ram 72; sometimes they require deliberate tilting when maneuvering a load into position.

Various accessories can be added to the apparatus 10. For the sake of completeness, a winch 122 has been included. The winch simply has entrained thereabout a flexible cable so that a hook can be suspended from the end of the cable over a sheave (not shown), thereby enabling a load to be hooked and lifted without making use of the fork carriage 106 when circumstances so dictate.

Operation

Having presented the foregoing description, the manner in which my apparatus 10 functions should be readily appreciated. Nonetheless, in order to fully appreciate all of the benefits to be derived from a practicing of my invention, a brief operational resume will now be given.

Figure 2:
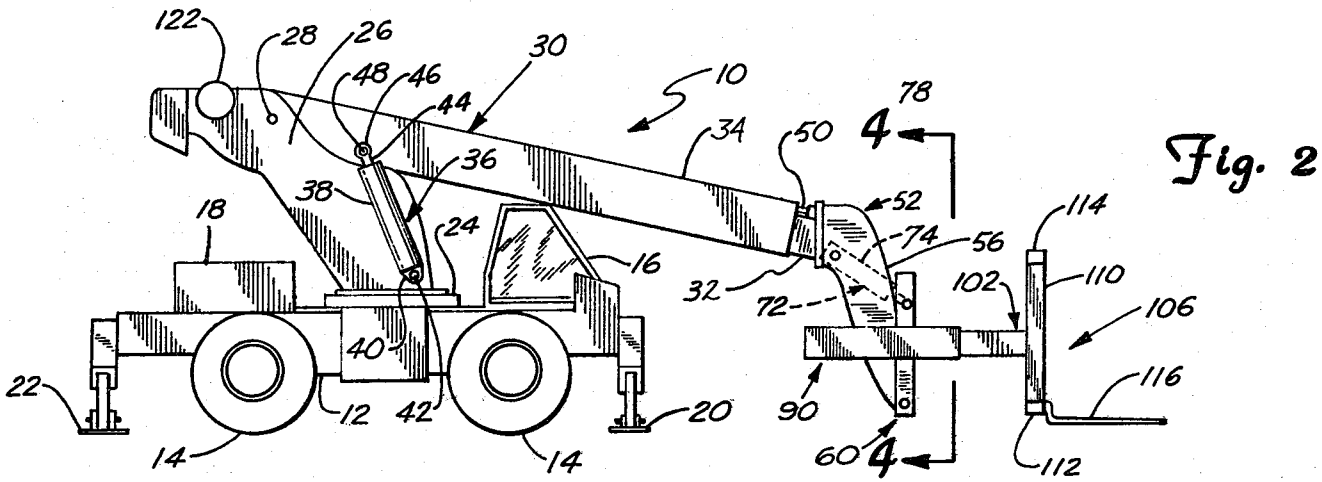
FIG. 2 is a side elevational view corresponding generally to FIG. 1 but with the boom assembly lowered and with the fork carriage partially retracted.

If a load 124 (shown in phantom in FIG. 1) is to be picked up from the ground, then the apparatus 10 would be positioned as illustrated in FIG. 2. Usually, the fork carriage 106 would be fully retracted, but in the illustrated condition it is partially retracted. In other words, the piston rods 100 of the rams 92 would be hydraulically urged or pulled into their respective hydraulic cylinders 94. The hydraulic lines, which are connected with the various pumps driven by the engine 18 are not pictured, as are the pumps themselves. However, it will be appreciated that various levers are manipulated from within the cab 16 in order to appropriately direct the hydraulic fluid under pressure into the hydraulic cylinders 94 in preparation for picking up a load, such as that labeled 124 in FIG. 1.

Assuming that the load 124 is on a pallet 126, the retraction of the fork carriage 106 will enable the fork members 116 to be extended or inserted into the voids or spaces beneath the pallet 126. On the other hand, when initially picking up the load 124, the chassis 12 could be advanced so as to have the fork members 116 move beneath the pallet 126.

At any rate, once the fork members 116 have engaged the load 124, more precisely the pallet 126 in the pictured instance, to be elevated, then the rams 36 are hydraulically actuated so as to raise the boom assembly 30, actually swinging it upwardly about the horizontal shaft 28. Depending upon the reach that is required for the particular load 124, the boom section 34 can be extended from its telescopically received relation with the boom section 32 appearing in FIG. 2 to, say, that illustrated in FIG. 1.

Inasmuch as the angulation of the boom assembly 30 has been changed in going from FIG. 2 to FIG. 1, it follows that an adjustment is needed as far as the tilt imparted to the fork carriage 106 is concerned. This is readily achieved, either automatically or manually, through the agency of the tilt ram 72.

Assuming that a building 128 is under construction and that it has a vertical wall 130 associated therewith as well as a horizontal floor 132 that the load 124 is to be placed on, it will be seen that the fork carriage 106 can be extended in a horizontal direction without changing the height of the fork carriage, the rams 92 readily permitting this to be done. It will be recognized, it is believed, that without the extension and retraction capability made possible by my invention, if the entire apparatus 10 is moved, there can be interference between the boom assembly 30 and the vertical wall 130. By the same token, if a transfer carriage is mounted on tracks on the chassis 12, as in the case of the patented apparatus hereinbefore referred to, interference can likewise be encountered with the vertical wall 130.

However, when resorting to the teachings of my invention, the boom assembly 30 can be raised and actually brought into close juxtaposition with the vertical wall 130 and then the load 124 carried by the fork carriage 106 extended through the agency of the rams 92 so as to deposit the load 124 on the elevated floor 132, doing so without having to extend or retract the boom assembly 30 at all. In this way, the load 124 can be deposited inwardly of the vertical wall 130 that is farther to the right in FIG. 1 as indicated by the arrow 134. In other words, the load 124 need not be deposited closely adjacent the wall 130.

I claim:

1. Loading apparatus comprising a mobile chassis, telescopic boom means mounted adjacent one end thereof to said chassis for pivotal movement about a horizontal axis, first power means for pivotally moving said boom means to thereby cause the other end of said boom means to be raised and lowered, first support means mounted on said other end of said boom means, second support means mounted on said first support means for pivotal movement about a second horizontal axis parallel to said first axis, second power means connected to said second support means for pivotally moving said second support means about said second axis, fork means, and third support means carried on said second support means mounting said fork means to said second support means for reciprocal movement relative to said second support means, whereby said fork means can be extended and retracted relative to said boom means.

2. Loading apparatus in accordance with claim 1 in which said third support means includes a hydraulic cylinder fixedly anchored to said second support means and a piston slidably disposed in said cylinder for reciprocating said fork means.

3. Loading apparatus in accordance with claim 2 in which said fork means comprises a pair of laterally spaced fork members, said fork means being fixedly connected to said slidable piston for movement in the same direction as said piston.

4. Loading apparatus in accordance with claim 3 in which said third support means includes a rectangular frame having vertical side portions, a transverse bottom portion and a transverse top portion, said fork members being fixedly attached to said transverse bottom portion.

5. Loading apparatus in accordance with claim 1 in which said third support means includes a pair of rams, each ram including a hydraulic cylinder and a piston slidably disposed therein, said third support means further including a pair of reciprocal elongated members connected at one end to the free ends of said pistons, said fork means being fixedly connected to the other ends of said elongated members.

6. Loading apparatus in accordance with claim 5 in which said elongated mambers constitute a pair of laterally spaced arms and means constraining said arms for reciprocal movement in a rectilinear path by said piston rods.

7. Loading apparatus in accordance with claim 6 in which said third support means includes a box-like housing for each of said arms, said arms being slidable in the box-like housing with which it is received and each box-like housing constraining its arm for reciprocal movement in said rectilinear path.

8. Loading apparatus in accordance with claim 7 in which said arms are channel-shaped having parallel sidewalls and a bottom wall, said box-like housings having parallel sidewalls, a bottom wall and a top wall providing a recess conforming to the cross section of said arms, the sidewalls, bottom wall and top wall of said box-like housings constraining the sidewalls and bottom walls of said arms to provide said reciprocal movement in said rectilinear path.

9. Loading apparatus in accordance with claim 8 in which said second support means includes a rectangular frame pivotally mounted on said first support means and one side of each box-like housing is fixedly secured to one side of said rectangular frame.

10. Loading apparatus in accordance with claim 8 including a turntable, said one end of said boom means being mounted on said turntable, and stabilizer means at each end of said chassis for supporting said chassis irrespective of the rotation position of said turntable.

11. Loading apparatus comprising a mobile chassis, a turntable on said chassis, a pair of upright standards on said turntable, a horizontal shaft extending between said standards to provide a first pivotal axis, a telescopic boom assembly mounted adjacent one end thereof to said shaft for pivotal movement about said axis, a boom head fixedly attached to the free or other end of said boom assembly, a carriage head pivotally mounted on said boom head, a fork carriage, and means reciprocably mounting said fork carriage to said carriage head so that said fork carriage can be extended and retracted with respect to said boom assembly.

12. Loading apparatus in accordance with claim 11 in which said last-mentioned means includes a pair of hydraulic cylinders anchored to the opposite sides of said carriage head, each cylinder having slidably disposed therein a reciprocal piston, and an arm connected to the free end of each of said reciprocal pistons, said arms also being connected to said fork carriage.

13. loading apparatus in accordance with claim 12 in which said last-mentioned means also includes a pair of box-like housings each having parallel sidewalls, a bottom wall and a top wall, said arms being slidable within said housings.

14. Loading apparatus in accordance with claim 13 in which one sidewall of each of said housings is secured to said carriage head.

15. Loading apparatus in accordance with claim 14 in which said hydraulic cylinders are contained in said housings, the anchoring of said cylinders to the opposite sides of said carriage head being via said sidewalls.

16. Loading apparatus in accordance with claim 15 including a pin extending between the sidewalls of each housing and part of the cylinder contained therein.

17. Loading apparatus in accordance with claim 16 including stabilizer means at each end of said chassis so as to stabilize said chassis for various rotative positions of said turntable.

18. Loading apparatus in accordance with claim 17 in which said boom assembly includes first and second telescopically received boom sections, said first boom section being pivotally mounted on said shaft and said boom head being fixedly attached to said second boom section.

19. Loading apparatus comprising a mobile chassis, telescopic boom means mounted adjacent one end thereof to said chassis for pivotal movement about a horizontal axis to thereby permit the other end of said boom means to be raised and lowered, means pivotally attached to the other end of said boom means, a reciprocal means mounted on said pivotal means, and a forklift mounted on said reciprocal means so that said forklift can be tilted into various angular positions relative to said other end of the boom means as determined by the angular position of said pivotal means and can also be extended and retracted into various positions relative to the other end of said boom means as determined by said reciprocal means.

20. Loading apparatus comprising a mobile chassis, telescopic boom means supported adjacent one end for pivotal movement about a generally horizontal axis, power means connected to said boom means for causing pivotal movement of said boom means about said horizontal axis to raise and lower the other end of said boom means, generally vertical support means pivotally mounted adjacent said other end of said boom means for pivotal movement about a second generally horizontal axis, power means connected to said support means for causing pivotal movement of said support means about said second axis relative to said boom means, additional support means mounted on said generally vertical support means, said additional support means projecting generally horizontally from said generally vertical support means when said generally vertical support means has been pivoted into a vertical position by said last-mentioned power means, said additional support means including a member having a free end reciprocally movable with respect to said generally vertical support means, and a forklift fixedly mounted on the free end of said reciprocally movable member.

21. Loading apparatus comprising a mobile chassis, a pair of standards extending in an upright direction from said chassis, a horizontal shaft extending between said standards to provide a first pivotal axis, a telescopic boom assembly mounted adjacent one end thereof to said shaft for pivotal movement about said axis, a boom head fixedly attached to the free or other end of said boom assembly, a carriage head pivotally mounted on said boom head, a fork carriage, and means reciprocably mounting said fork carriage to said carriage head so that said fork carriage can be extended and retracted with respect to said boom assembly.

* * * * *